US007401749B2

(12) United States Patent
Yang et al.

(10) Patent No.: US 7,401,749 B2
(45) Date of Patent: Jul. 22, 2008

(54) HOLDER FOR PAPER TOWEL ROLLS WITH A QUICK-RELEASE RETRACTABLE HANDLE

(75) Inventors: Frank Yang, Rancho Palos Verdes, CA (US); Myk Wayne Lum, Irvine, CA (US); Joseph Sandor, Santa Ana Heights, CA (US)

(73) Assignee: Simplehuman LLC, Torrance, CA (US)

( * ) Notice: Subject to any disclaimer, the term of this patent is extended or adjusted under 35 U.S.C. 154(b) by 135 days.

(21) Appl. No.: 11/251,460

(22) Filed: Oct. 14, 2005

(65) Prior Publication Data

US 2006/0266876 A1 Nov. 30, 2006

Related U.S. Application Data

(63) Continuation-in-part of application No. 11/094,808, filed on Mar. 29, 2005, which is a continuation of application No. 29/223,227, filed on Feb. 9, 2005, now Pat. No. Des. 518,985.

(51) Int. Cl.
*B65H 16/04* (2006.01)

(52) U.S. Cl. ..... 242/597.7

(58) Field of Classification Search ..... 242/597.3, 242/597.4, 597.6, 597.7, 599, 599.3, 599.4
See application file for complete search history.

(56) References Cited

U.S. PATENT DOCUMENTS

| | | | |
|---|---|---|---|
| 3,370,805 | A | 2/1968 | Barbee |
| 4,030,676 | A | 6/1977 | Bardsley |
| 4,487,376 | A | 12/1984 | Compton |
| 4,690,345 | A | 9/1987 | Cotey |
| 4,720,053 | A | 1/1988 | Vance |
| 4,738,385 | A | 4/1988 | Bell |
| D298,290 | S | 11/1988 | Wilkerson |

(Continued)

FOREIGN PATENT DOCUMENTS

| | | |
|---|---|---|
| DE | 3613988 | 9/1987 |

(Continued)

OTHER PUBLICATIONS

Website page, www.oxo.com, Grip & Rip Paper Towel Holder—Stainless Steel, OXO International.

(Continued)

*Primary Examiner*—William A Rivera
(74) *Attorney, Agent, or Firm*—Liu & Liu

(57) ABSTRACT

A paper towel holder facilitates tearing of paper towels from a continuous roll of paper towels supported on the holder, and prevents excessive unraveling of the roll. A portable paper towel holder has a vertical pole and a base having an annular rim of uneven height. The uneven annular rim provides the combination of tall and short sections to balance between effectively holding the towel from excess unraveling, and facilitating ease of tearing of paper towel pieces from the roll. A releasable handle is provided at the distal end of the pole to securely retain the paper towel roll on the vertical pole. The handle is provided with recessed releasing buttons for releasing the handle from the pole. A further embodiment provides a quick-release, detachable, spring-biased retractable handle for applying a braking force to restrain the towel roll from rotation about the pole.

20 Claims, 18 Drawing Sheets

U.S. PATENT DOCUMENTS

| | | | | |
|---|---|---|---|---|
| D298,597 | S | | 11/1988 | Bell |
| 5,135,179 | A | * | 8/1992 | Morano |
| 5,170,956 | A | | 12/1992 | McTaggart |
| 5,477,709 | A | * | 12/1995 | Rowe |
| 5,718,108 | A | * | 2/1998 | Oppl et al. |
| D398,466 | S | | 9/1998 | Odom |
| 5,938,141 | A | | 8/1999 | Kanbar |
| D432,826 | S | | 10/2000 | Shimbo et al. |
| D450,962 | S | | 11/2001 | Hundley |
| 6,467,717 | B1 | | 10/2002 | Pedicano et al. |
| 6,478,246 | B2 | * | 11/2002 | Fahringer |
| D477,730 | S | | 7/2003 | Hoernig |
| D486,333 | S | | 2/2004 | Hoernig |
| D489,558 | S | | 5/2004 | Snell |
| D499,916 | S | | 12/2004 | Yang et al. |
| 7,140,573 | B1 | * | 11/2006 | Jerstroem et al. |
| 7,264,197 | B2 | | 9/2007 | Yu |
| 2002/0070308 | A1 | | 6/2002 | Fahringer |
| 2003/0029961 | A1 | | 2/2003 | Holliger |
| 2004/0159738 | A1 | * | 8/2004 | Duncan et al. |
| 2006/0284001 | A1 | * | 12/2006 | Paradise et al. |

FOREIGN PATENT DOCUMENTS

| | | |
|---|---|---|
| EP | 473247 | 3/1992 |

OTHER PUBLICATIONS

Website page, www.oxo.com, Grip & Rip Paper Towel Holder—White, OXO International.
Website page, www.cooking.speedera.net.
Website page, http://store.yahoo.com/organizeeverything1, Grip & Rip Paper Towel Holder by OXO—Stainless Steel Model.
Website page, http://store6.yimg.com/I/organizeeverything1.
Website page, http://store.yahoo.com/organizeeverything1, Grip & Rip Paper Towel Holder by OXO—White Model.
Website page, http://www.cooking.com, OXO Stainless Steel Paper Towel Holder.
Website page, www.oxo.com, Simply Tear Paper Towel Holder—Stainless Steel, OXO International.

* cited by examiner

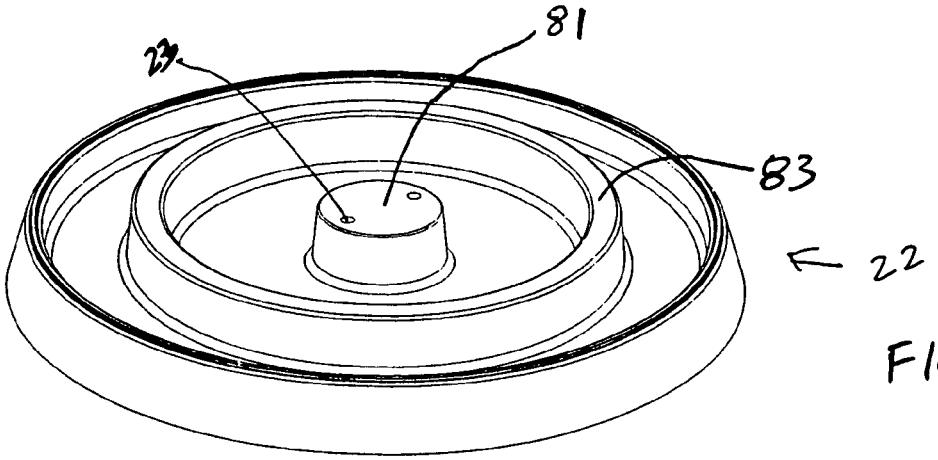
FIG. 6
FIG. 7
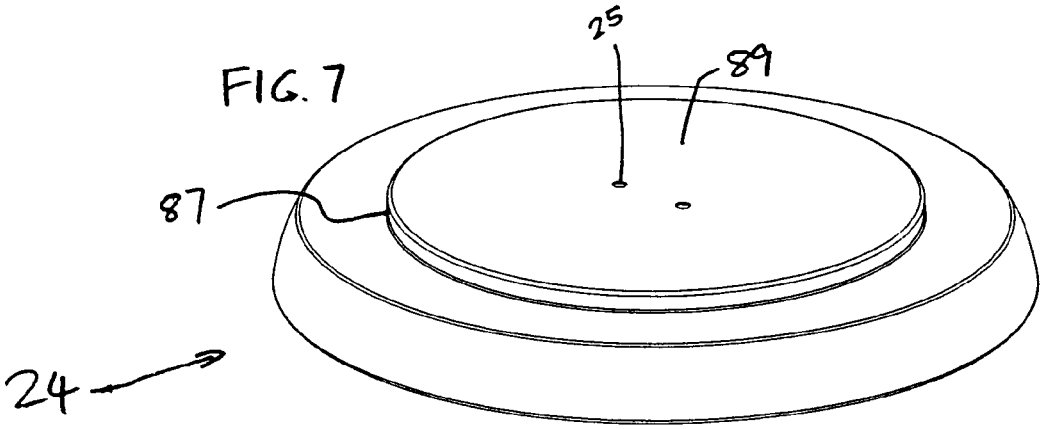
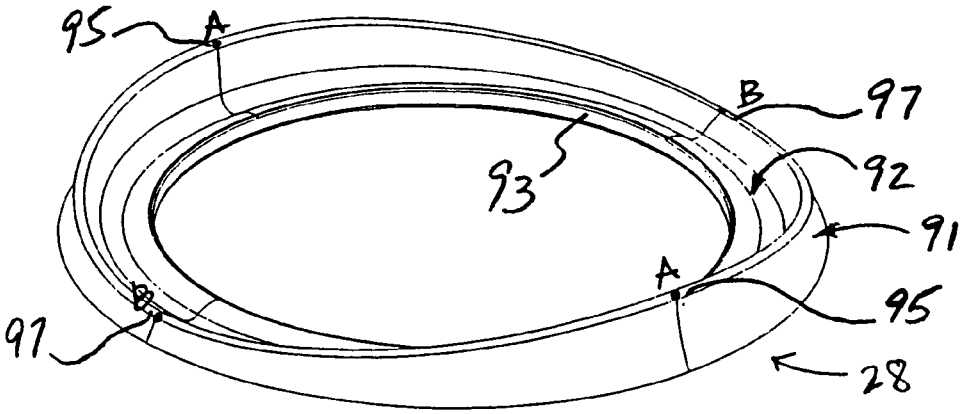
FIG. 8

FIG. 9
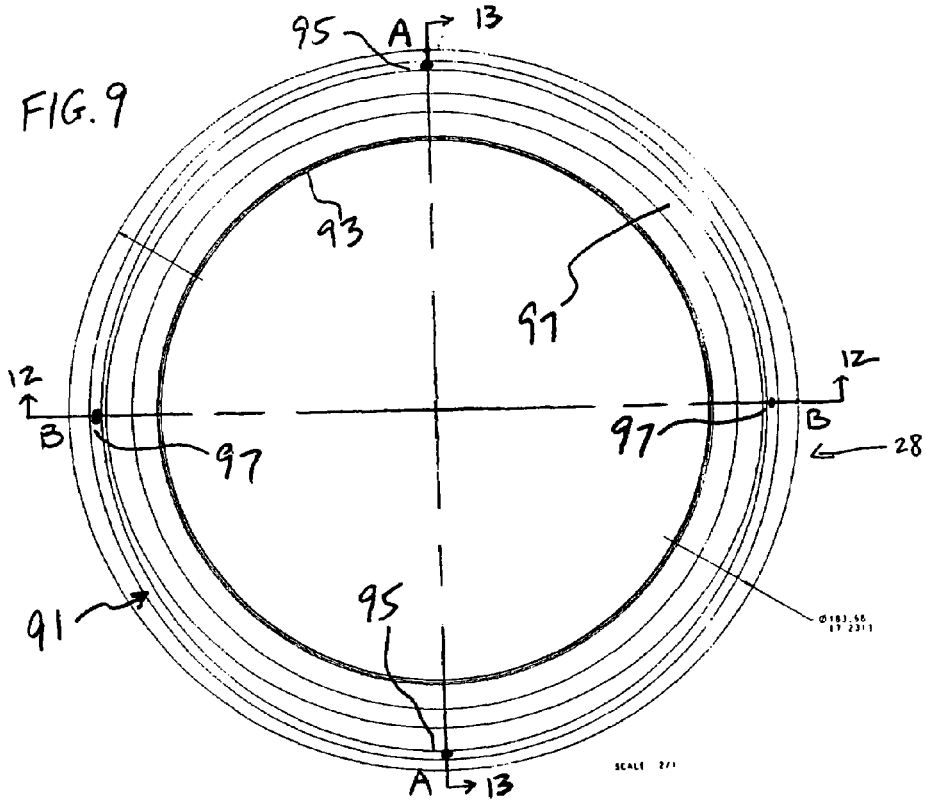
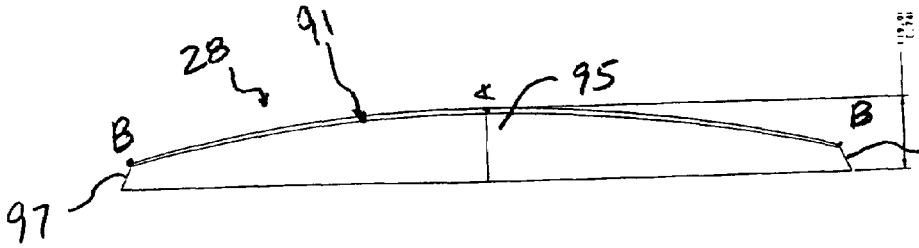
FIG. 10
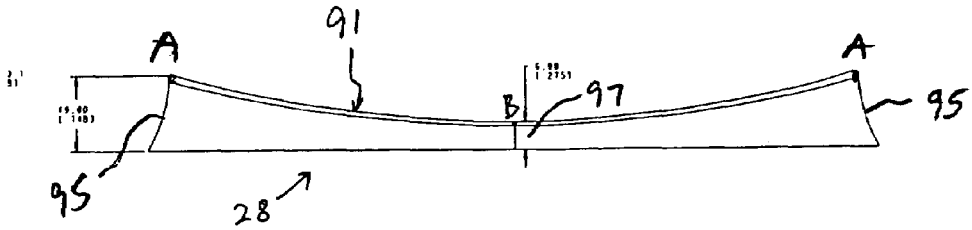
FIG. 11

HOLDER FOR PAPER TOWEL ROLLS WITH A QUICK-RELEASE RETRACTABLE HANDLE

RELATED CASES

This application is a continuation-in-part of copending U.S. patent application Ser. No. 11/094,808 entitled "Holder for Paper Towel Rolls", filed Mar. 29, 2005, which is a continuation-in-part of co-pending U.S. Design Application No. 29/223,227 entitled "Wall Mount Paper Towel Holder", filed Feb. 9, 2005; these application are being hereby incorporated by reference as if fully set forth herein.

FIELD OF INVENTION

The invention relates to holders for holding and dispensing paper towel rolls.

BACKGROUND OF INVENTION

Paper towel rolls are commonly used for household cleaning tasks. Within the roll, paper towels are defined in a continuous roll, by perforations across the roll. Holders have been designed to securely support the paper towel rolls at convenient locations for dispensing to users. One type of paper towel holder supports the paper towel roll with its axis oriented horizontally with respect to end supports. Another type of paper towel holder supports the paper towel with its axis oriented vertically with respect to a base. In the past, horizontal paper towel holders are mounted to a vertical support surface (e.g., wall-mounted), and vertical paper towel holders are free-standing on its base. Because of the vertical orientation of the paper towel in a vertical holder, the paper towel roll has a tendency to unravel as the towel roll relaxes under its own weight. Further, some of the past designs do not provide user with an easy way of tearing a piece of towel from the roll without dragging and unrolling too much of the roll on the holder.

U.S. Pat. No. 4,030,676 describes a vertical paper towel holder with a pole extending vertically from a base. The vertical pole includes a fixed handle for users to grasp and lift the holder. An annular rim of uniform height is provided at the edge of the base. According to the patent disclosure, the annular rim facilitates detachment of individual towel segment from the roll. However, it has been found that such design has its limitations, and often do not work as well as disclosed.

What is needed is an improved paper towel holder that facilitates ease of dispensing of paper towels from a roll.

SUMMARY

The present invention provides a novel paper towel holder that facilitates tearing of thin ply sheets from a roll, such as paper towels from a continuous roll of paper towel, supported on the holder, and prevents excessive unraveling of the roll.

In one aspect of the present invention, a vertical paper towel holder having a base and a vertical pole is provided with an annular rim of uneven height at the periphery of the base. The shorter sections of the rim do not present too much obstruction to the necessary unrolling of the roll when a piece of paper towel is pulled before it is to be torn off. The taller sections of the annular rim provide sufficient structure to prevent excessive unraveling of the roll, and to present a structure that facilitates the tearing of the piece of paper towel from the roll. The uneven annular rim having the combination of tall and short sections provides an ideal balance between effectively holding the towel from excess unraveling, and facilitating ease of tearing of paper towel pieces from the roll. In one embodiment of the present invention, the annular rim is made of plastic, which is fitted on a base made of metal, such as stainless steel. The metal base provides a sturdy platform with a durable finish. The plastic rim enables sufficient height that is effective at preventing unraveling of the roll. It has been found that metal such as stainless steel may not be as suitable a material as plastic to as easily form the rim of sufficient height.

In another aspect of the present invention, a releasable handle is provided at the distal end of the vertical pole. The handle is used to securely retain a paper towel roll on the vertical pole, and provides a convenient structure for the user to grab on to when lifting the holder. The handle is provided with releasing buttons for releasing the handle from the pole. These buttons are recessed flush with the external profile of the handle. The recessed buttons prevent accidental release of the handle when the user places the palm of her hand on the handle.

In a further aspect, the present invention provides a paper towel holder that is structured for mounting to a vertical surface, such as a wall or the side of a cabinet. Instead of an annular lip to facilitate tearing of individual pieces of towel from the roll, a spring is provided to provide a bias in the axial direction, thus creating resistance to the unrolling of the roll, to facilitate tearing of the paper towel from the roll. The roll is prevented from excessive unraveling by the vertical mounting.

In yet another aspect, the present invention provides a paper towel holder that includes a retractable handle that can be used to apply a braking force to retrain rotation of the paper towel roll. In accordance with one embodiment of the present invention, the handle is structured for quick release detachment from the holder, without requiring disassembly of any components. The handle provides a spring bias against the end of the pole on the base, allowing the handle to be depressed by a user applying a force towards the end of the pole, so that a bottom surface of the handle is pressed against the core of the roll. Rotation of the roll about the pole is thereby restrained by the braking force or friction between the roll core and the bottom surface of the handle. Upon release of the pushing force, the handle is biased to move away from the roll core, thereby releasing the roll to allow it to rotate about the pole. In one embodiment, the spring bias is provided by a coil spring retained in the handle.

BRIEF DESCRIPTION OF DRAWINGS

For a fuller understanding of the nature and advantages of the invention, as well as the preferred mode of use, reference should be made to the following detailed description read in conjunction with the accompanying drawings. In the following drawings, like reference numerals designate like or similar parts throughout the drawings.

FIG. 6 is a perspective view of the weight in the base, in accordance with one embodiment of the present invention.

FIG. 7 is perspective view of the cover of the base, in accordance with one embodiment of the present invention.

FIG. 8 is perspective view of the annular retaining ring of the bas, in accordance with one embodiment of the present invention.

FIG. 9 is a top view of the retaining ring of FIG. 8.

FIG. 10 is a side view of the retaining ring of FIG. 8, on the side having the taller section.

FIG. 11 is another side view of the retaining ring of FIG. 8, on the side having the shorter section.

DETAILED DESCRIPTION OF DRAWINGS

The present description is of the best presently contemplated mode of carrying out the invention. This description is made for the purpose of illustrating the general principles of the invention and should not be taken in a limiting sense. The scope of the invention is best determined by reference to the appended claims.

This invention has been described herein in reference to various embodiments and drawings. It will be appreciated by those skilled in the art that variations and improvements may be accomplished in view of these teachings without deviating from the scope and spirit of the invention. By way of illustration, the present invention will be described in reference to paper towel rolls of the kind typically used in household kitchens. Other types of rolls of thin ply sheets may be used in connection with the present invention.

The paper towel roll has a tube shaped core that supports a continuous roll of paper towels. The width of the roll is larger than the diameter of a full roll of paper towels. Individual pieces of paper towels (e.g., rectangular shaped) are defined by perforations across the roll. The perforation defines lines of weakness in the roll, to facilitate tearing of the roll to separate the individual pieces of paper towels. Paper towel rolls of other shapes and sizes, with or without perforations, may be used with the present invention. As used herein, paper towel roll includes paper rolls that may comprise absorbent or not absorbent paper sheets.

Figure 1:
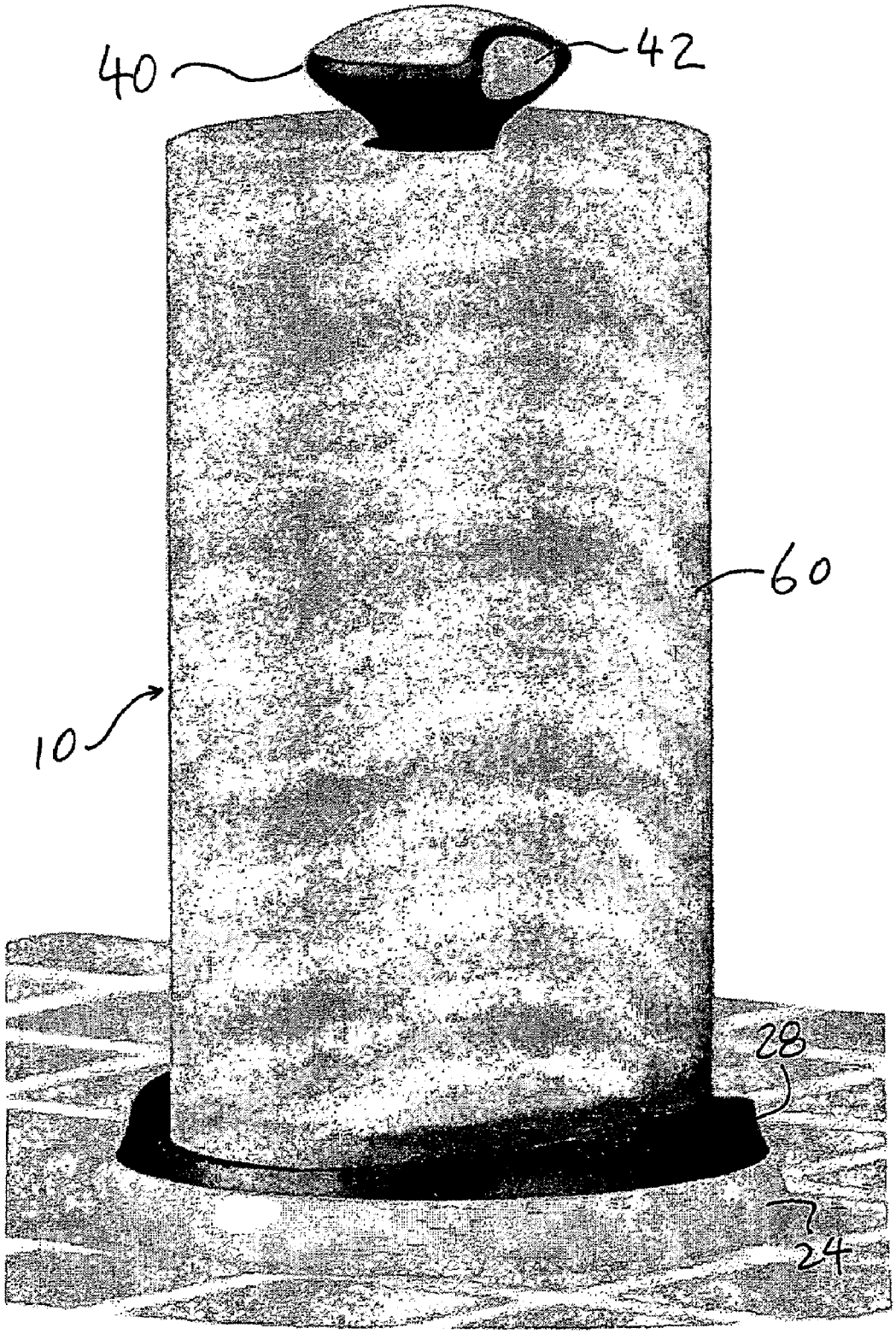
FIG. 1 is a perspective view of one embodiment of the paper towel holder of the present invention holding a roll of paper towels in place.
Figure 2:
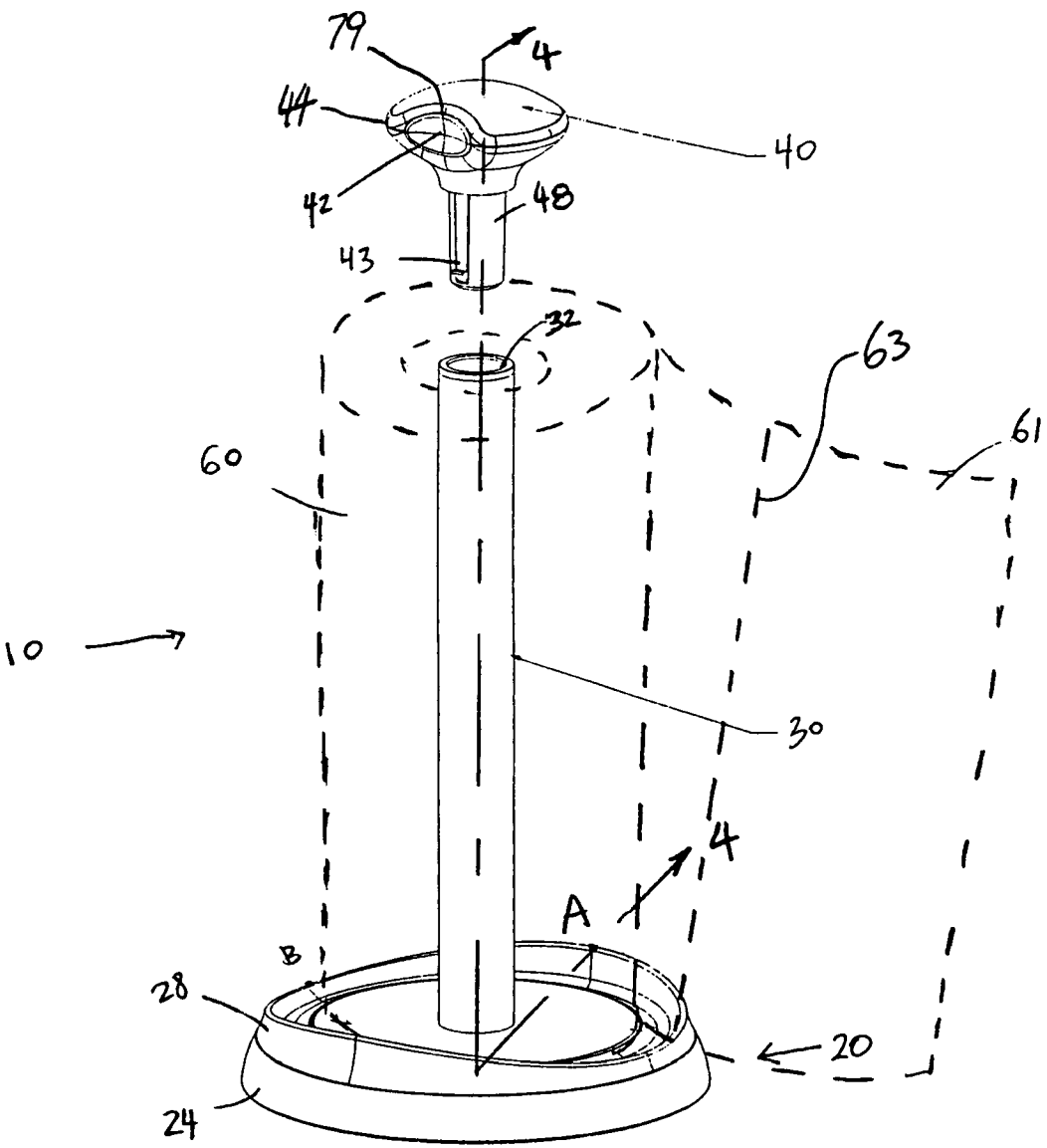
FIG. 2 is another perspective view of the embodiment of the paper towel holder of the present invention without the paper towel roll in place.

In one embodiment of the present invention, the paper towel holder is of the type that is free-standing and portable, structured to support a paper towel roll with its axis oriented vertically. FIG. 1 is a perspective view of a paper towel holder 10 in accordance with one embodiment of the present invention, supporting a roll 60 of paper towels. FIG. 2 is a perspective view showing the holder 10 standing alone, with the paper towel roll 60 indicated by dotted lines. The holder 10 comprises primarily a pedestal or base 20, a pole in the form of a tube 30 vertically supported on the base 20, and a handle 40 releasably attached to the top distal end of the tube 30.

Figure 3:
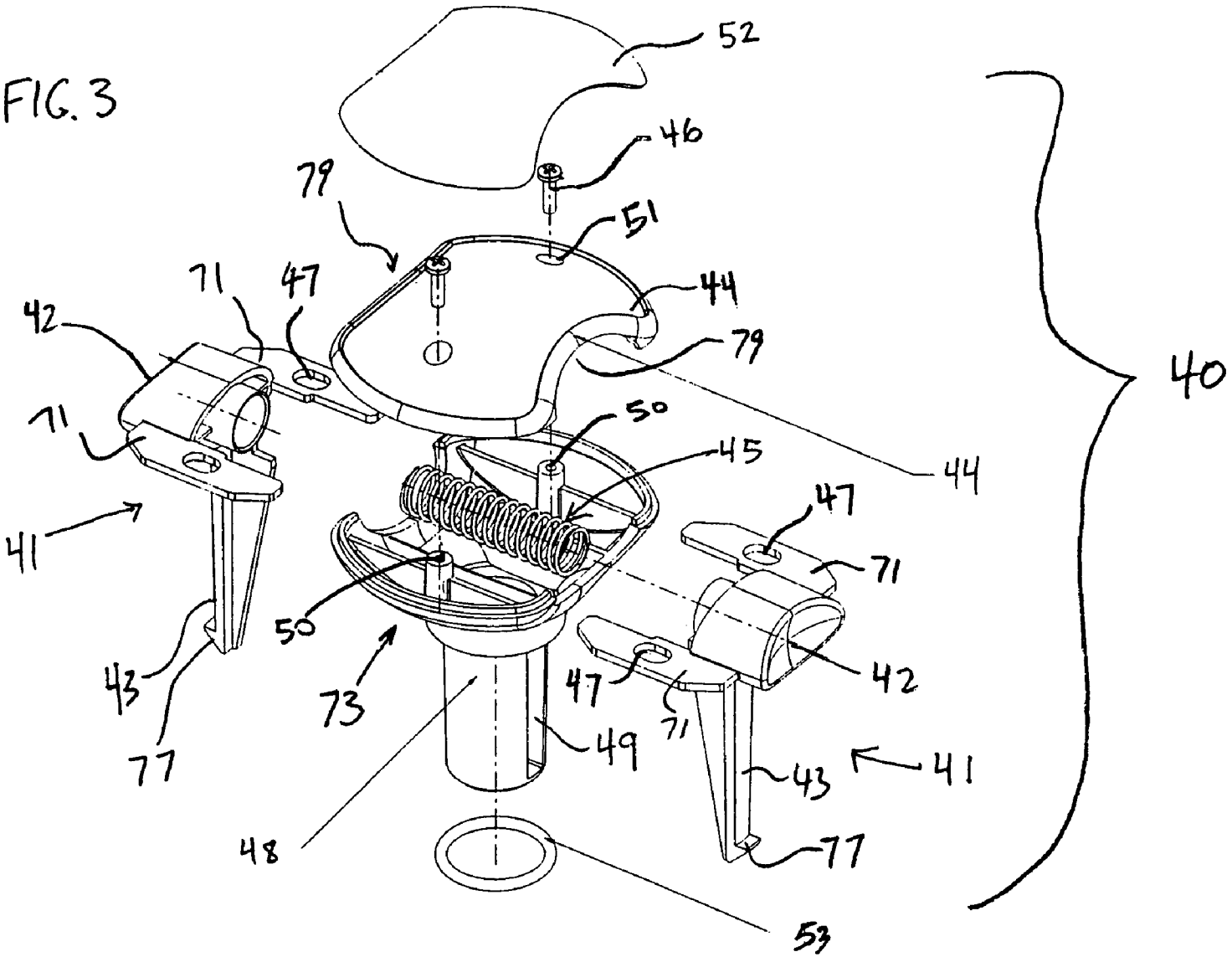
FIG. 3 is an exploded perspective view of the releasable handle of FIG. 2, in accordance with one embodiment of the present invention.

FIG. 3 is an exploded view of one embodiment of handle 40. The releasable handle 40 generally resembles a knob. The handle 40 comprises two release buttons 41, a body 73, and a cover 44. The structure of the release button 41 includes a button pad 42 attached to a latch 43, and a slider 71. The latch 43 has a hook 77 at its end. The slider 71 has oval holes 47 provided, which fit around the stubs 50 of the body 73. The oval holes 47 allow the slider 71 to slide relative to the stubs 50, in a radial direction as guided by the stubs 50. A hollow generally cylindrical or conical stem 48 extends from the bottom of the body 73. When assembled to the body 73, each latch 43 is inserted through the hollow stem 48, and has its hooks 77 extending through slots 49 in the stem 48. A spring 45 is provided to bias the two latches 43 away from each other, thereby exposing the hooks of the latch 43 through the slots 49 under bias of the spring 45. The cover 44 securely retains the spring and the holes 47 of the sliders 71 onto the stubs 50. Screws 46 are provided to secure the cover 44 in place on the body 73. A face-plate 52 provides a desirable external finish to the handle 40, concealing the screws 46. A spacer o-ring 53 may be provided around the stem 48 of the body 73. The body 73, cover 52 and/or the release button 41 may be molded from plastic. The face-plate 52 may be a thin sheet of metal, such as stainless steel or aluminum, having a polished or textured surface finish.

Figure 4:
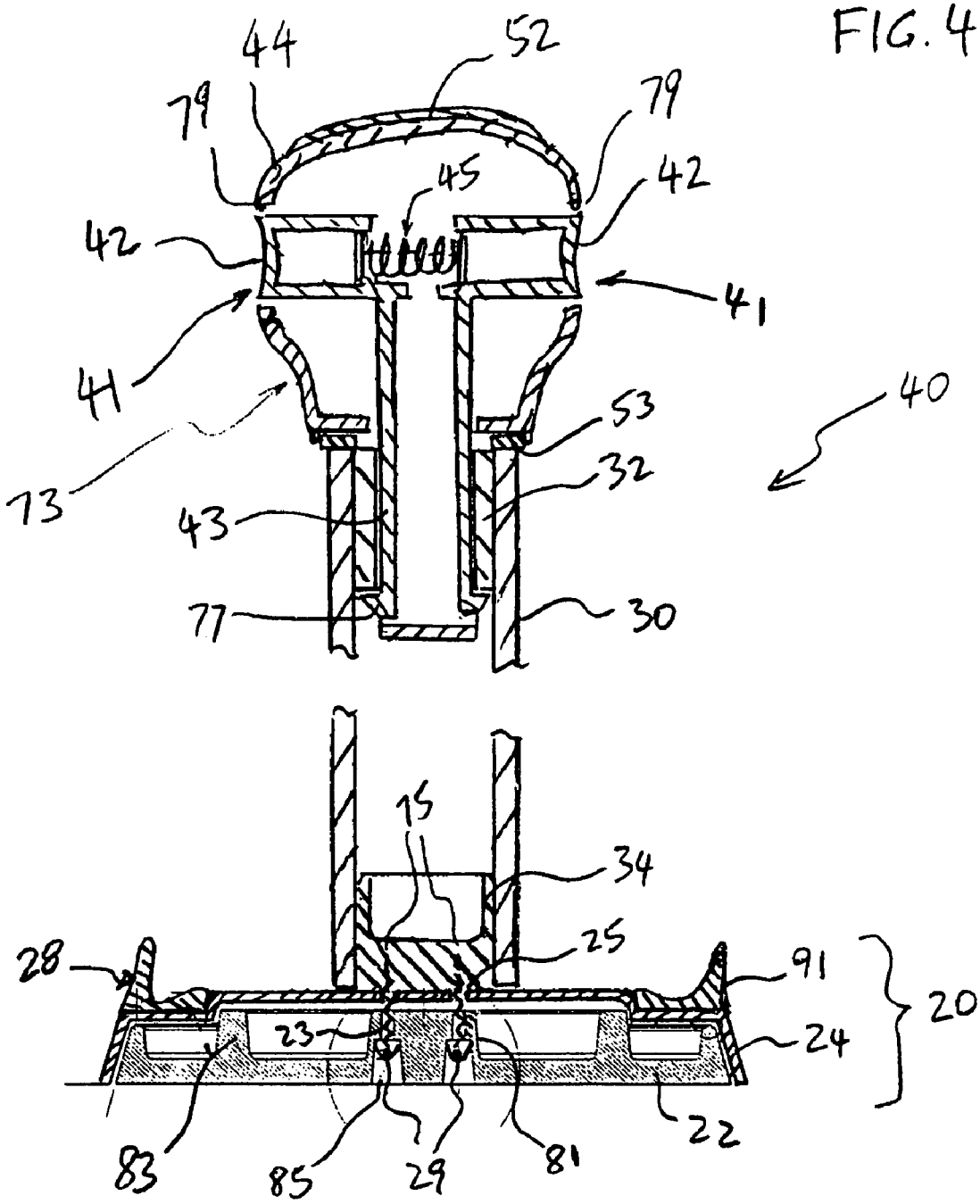
FIG. 4 is a cross-sectional view taken along line 4-4 of the paper towel holder of FIG. 2.

Referring to FIG. 4, the tube is hollow along its entire length. The tube may be made of metal (e.g., stainless steel or aluminum) or molded plastic, having a polished or textured surface finish. The external diameter of the tube 30 is sized to fit into the hollow hub of the paper towel roll 60, with a clearance to allow the relative rotation of the roll 60 with respect to the tube 30. At the top distal end of the tube 30, it has an inner diameter that is sized to receive a cylindrical insert 32, which may be made of rigid plastic. The inner diameter of the cylindrical insert 32 is sized to receive the stem 48 of the handle body 73. The length of the cylindrical insert 32 is such to allow the hooks 77 of the latch 43 to latch on to the lower edge of the cylindrical insert 32, when the handle body 73 is fully inserted into the cylindrical insert 32. To release the handle body 73 from the tube 30, the button pads 42 are depressed, such as by squeezing or pinching towards each other simultaneously against the spring bias, thereby retracting the hooks 77 to disengage from the bottom edge of the cylindrical insert 32.

Referring to FIGS. 1, 2, 3 and 4, it is noted that the knob shaped handle 40 has a generally convex profile with concave recesses 79 defined by the cover 44 and body 73, which recesses protect the button pads 42 from accidental depression. The button pads 42 are recessed from the surrounding convex body profile of the handle 40. In one embodiment, the button pads 42 are flush mounted in the concave recesses 79. The maximum extent of the exposed surfaces of the button pads 42 under the spring bias is substantially flush with the surrounding concave surface profile of the recesses 79 in the handle 40. That is, against the normal bias of the spring 45, the button pads 42 remain substantially flush with respect to the external surface of the handle 40. In another embodiment, the exposed surfaces of the button pads 42 generally do not extend appreciably beyond the surrounding concave recesses, such that even when the button pads 42 are pressed to the edge of the concave recesses, the hooks 77 do not disengage from the bottom edge of the cylindrical insert 32.

In order to release the handle 40 from the tube 30, the button pads 42 must be depressed with fingers to move the button pads 42 to below the edge of the recesses, so that the exposed surfaces of the button pads 42 are depressed into the body 74, below the surrounding concave surface profile of the recesses 79. This configuration of the release buttons 41 prevents accidental release of the handle 40, such as when she wishes to lift the holder 10 to relocate the holder, or to hold the holder in place with her hands. When a user grabs the handle 40 by placing her palm on the face-plate 52 on the cover 44, her fingers would wrap around the lower part of the handle body 73, but her finger tips would not be in contact with the button pads 42. Only when the user consciously depresses the button-pads 42 with her fingertips against the spring bias, can the handle 40 be released.

While the vertical pole for supporting the paper towel roll 60 is in the form of a uniform diameter tube 30 that is hollow along its entire length, it is well within the scope and spirit of the present invention, that the vertical pole may be embodied in the form of a solid or partial solid rod, having uniform or non-uniform inner and/or external diameter, with a cavity at the top distal end having a reduced diameter sized to receive the stem 48 of the handle body 73.

Referring to FIG. 4, the bottom end of the tube 30 is provided with a plug 34, which forms an anchor for mounting screws 29 that attach the tube 30 to the base 20, as will be further explained below. The plug 34 may be made of plastic, which is provided with guide holes 75 for receiving self-tapping screws 29.

Figure 5:
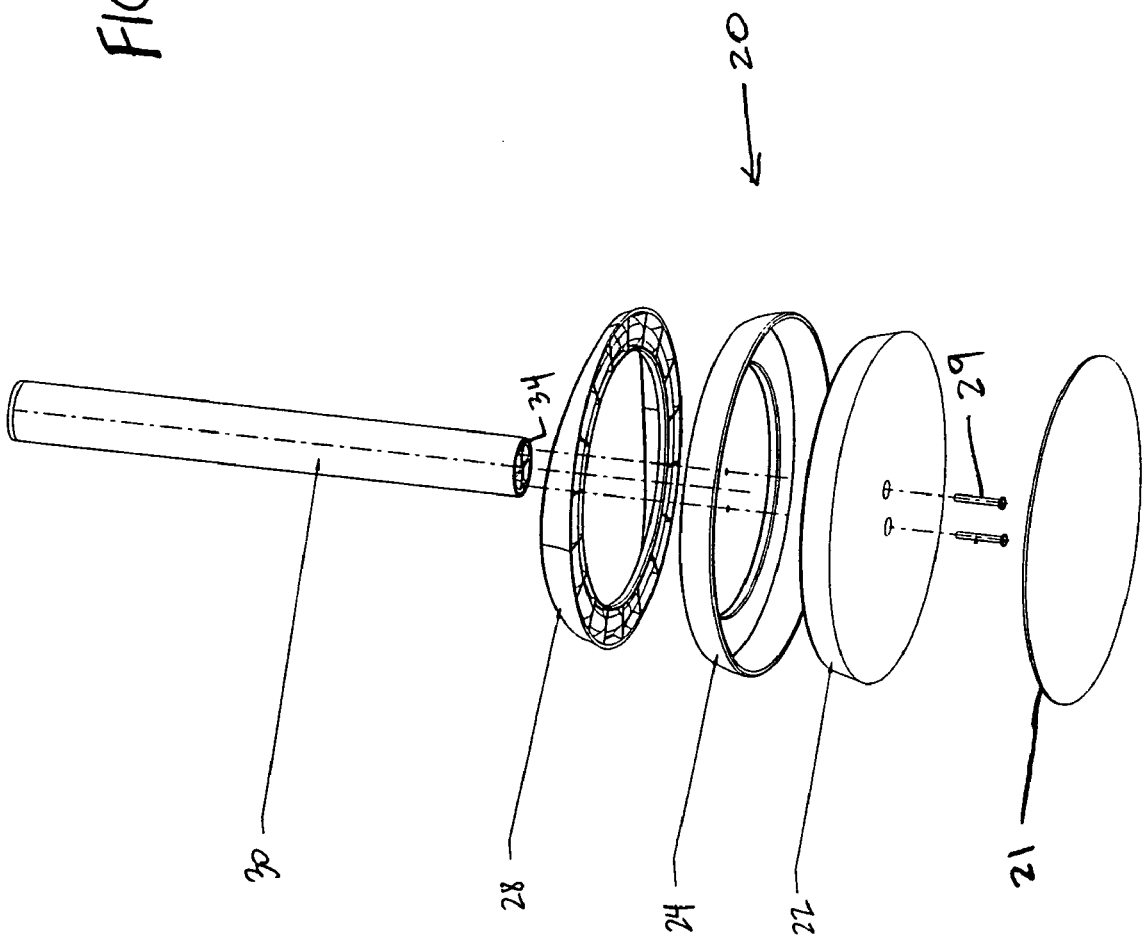
FIG. 5 is an exploded view showing the components of the base of the paper towel holder of FIG. 2, in accordance with one embodiment of the present invention.

FIG. 5 shows the components of the base 20, in accordance with one embodiment of the present invention. The base 20 comprises a weight 22, cover 24, and retaining ring 28. Referring also to FIG. 6, the weight 22 can be any material (e.g., metal such as lead, iron, etc.) of sufficient weight to provide the holder 10 with a weighted base to hold the holder 10 in place when a user pulls on the roll 60 and tears off a piece of paper towel using one hand, in the manner as will be further explained below. The configuration of the weight 20 may be structured to provide the desired weight. FIG. 6 illustrates a particular embodiment of the weight 22, having a concentric ring structure 83 and a center stub 81. If the weight 22 is in the form of a thick flat disc, it may be too heavy for the holder 10. The stub 81 provides the necessary thickness for mounting the tube 30. Specifically, the plug 34 is mounted to the stub 81, by applying the self-tapping screws 29 through clearance holes 85 in the stub 29, to thread to the guide holes provide in the plug 34.

Referring also to FIG. 7, the cover 24, resembling an inverted dish, covers the weight 22 (which may be unfinished), to provide a finished structure for the base 20. The cover 24 is provided with through holes 25 for receiving the screws 29. The top surface of the cover is provided with a raised center section 89 having an annular step 87, for fitting the retaining ring as further described below. The cover 24 may be made of plastic or metal, which may have a polished or textured finish. In the embodiment shown in FIG. 7, the cover 24 is made of stainless steel. A pad 21 may be provided below the weight 22, to provide a soft surface for resting on a support surface, such as a countertop. The pad 22 may comprise a material that prevents the base 20 from skidding on the support surface, and/or scratching the support surface.

In this embodiment, the base weight 22 and base cover 24 are in a circular configuration. They can be in other geometrical shapes, such as elliptical and polygonal shapes, without departing from the scope and spirit of the present invention.

Figure 13:
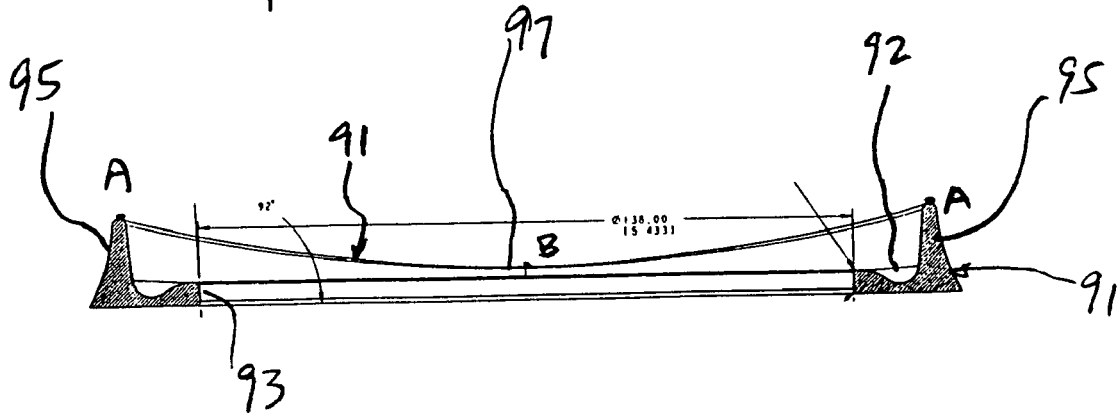
FIG. 13 is a cross-sectional view taken along line 13-13 of the retaining ring in FIG. 9.
Figure 12:
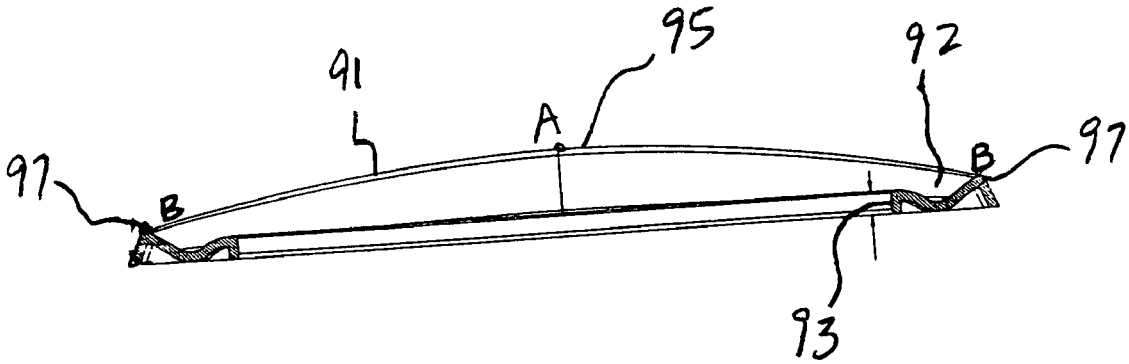
FIG. 12 is a cross-sectional view taken along line 12-12 of the retaining ring in FIG. 9.

Referring also to FIG. 8, the retaining ring 28 is supported on the base cover 24. FIGS. 8 to 14 illustrate the retaining ring 28 in accordance with one embodiment of the present invention. The retaining ring 28 has a structure in the form of an annulus, which can be made from molded plastic. As best seen in FIG. 13, the retaining ring 28 has an annular lip 91, an annular trench 92, and an annular inside wall 93. The annular inside wall has an inside diameter such that its surface can be interference fitted to the annular step 87 on the cover 24. The height of the annular inside wall 93 is about the same as the height of the raised center section 89 and the annular step 87 on the cover 24.

The annular lip 91 of the retaining ring 28 has uneven height circumferentially. Specifically, in the illustrated embodiment, the annular lip 91 has two taller lip sections 95 and two shorter lip sections 97. The taller lip sections 95 have highest point A, and the shorter lip sections have highest point B, as shown in the figures. The point B is higher than the height of the annular inside wall 93 and the height of the raised center section 89 and the annular step 87 on the cover 24. The annular lip 91 transitions gradually and smoothly from points A to points B around the circumference.

The annular lip 91 serves at least two purposes. First, it provides a barrier to prevent excessive unraveling of the paper towel roll 60 beyond the perimeter of the annular lip 91. When the retaining ring 28 is fitted over the cover 24, and a paper towel roll 60 is supported on the base 20, the bottom end of the paper towel roll 60 rests on the raised center section 89. The paper towel roll 60 may relax and unravel slightly, to extend the unraveled end to the annular lip 91, resting against the taller sections 95 and/or the shorter sections 97. Further unraveling is prevented by the annular lip 91.

Figure 14:
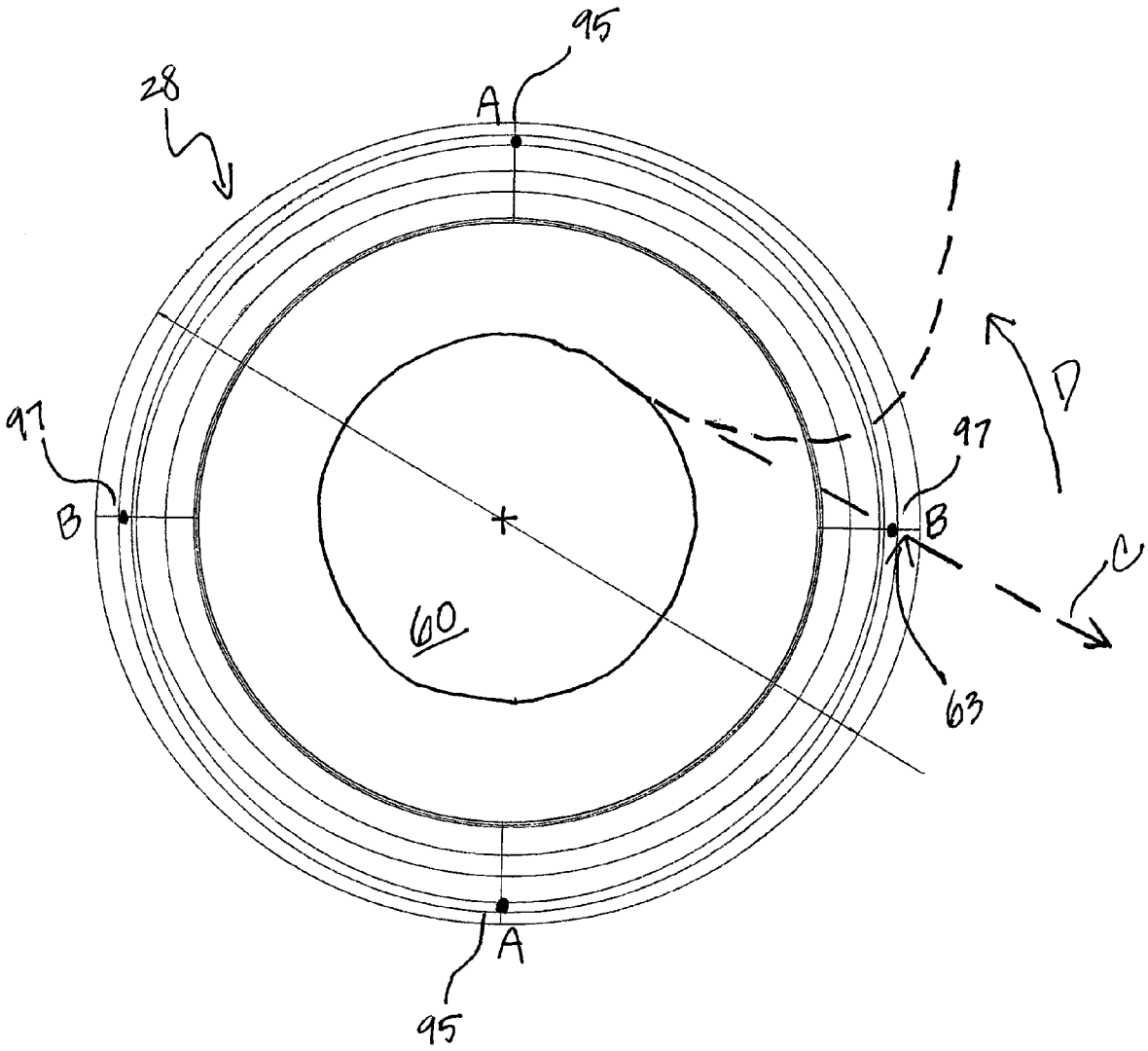
FIG. 14 is a top view of the paper towel holder.

Second, the annular lip 91 provides a structure that facilitates tearing off an individual piece of paper towel from the roll. The shorter sections 97 of the annular lip 91 do not present too much obstruction to the necessary unrolling of the roll when an end piece is pulled from the roll before it is to be torn off. Referring to FIG. 2, initially the end piece 61 is tugged roughly tangentially to the bulk of the roll 60 to unroll the end piece 61, along a direction (direction C indicated in FIG. 4) generally above and about the point B, until the perforation 63 is roughly above the point B. The taller sections 95 of the annular rim provide a structure that facilitates the tearing of the end piece of paper towel 61 from the roll 60. Referring to FIG. 14, to tear off the end piece 61, it is further tugged, and with a slight downward motion, and "peeled" in the general direction D, the bottom edge of the end piece 61 rub against the annular lip 91. Specifically, the bottom edge of the end piece 61 is caused to slide from generally point B of the shorter section 97 towards point A of the taller section 95. The sliding or rubbing action creates sufficient resistance to hold the bulk of the roll 60 against the continuous tugging of the end piece 61. The action and reaction between the tugging force and this resistance, and further the sliding or rubbing action against the annular lip section 95, cause the end piece 61 to initiate and tear at the perforation 63, and further tugging and peeling would tear the end piece 61 completely off from the roll 60. The tearing may occur prior to reaching point A.

As can be appreciated, the tearing of the end piece 61 by the above described "tug and peel" action can be achieved by using one hand, without the assistance of another hand to hold the roll from further unrolling. Given the weighted base 20 of the holder 10, the holder 10 would be sturdy enough to stay in place during the process, without the need to use another hand on the holder. This facilitates dispensing of paper towels, especially in a work environment such as a kitchen, in which one hand of the user may be occupied, while the other hand is the only hand available to tear off a piece of paper towel. The paper towel roll 60 may be placed on the holder 10 in opposite orientation as illustrated. For example, a user who is left-handed may prefer to have the paper towel roll 60 be placed to unroll and unravel in a counter-clockwise manner.

The uneven annular rim having the combination of tall and short sections provides an ideal balance between effectively holding the towel from excess unraveling, and facilitating ease of tearing of paper towel pieces from the roll. In one embodiment, the cover 24 is made of stainless steel, and the retaining ring 28 is made of molded plastic. The cover 24, enclosing the weight 22, provides a sturdy platform with a durable finish. The plastic rim enables sufficient height that is effective at preventing excessive unraveling of the roll. It has been found that a metal such as stainless steel may not be as suitable a material as plastic, since stainless steel is not as easy to roll form the annular lip of sufficient height.

Figure 15:
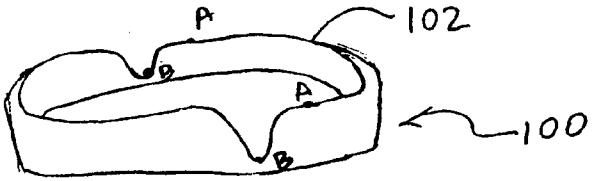
FIGS. 15 to 17 illustrates the rim profile of the retaining ring in accordance with additional embodiments of the present invention.
Figure 16:
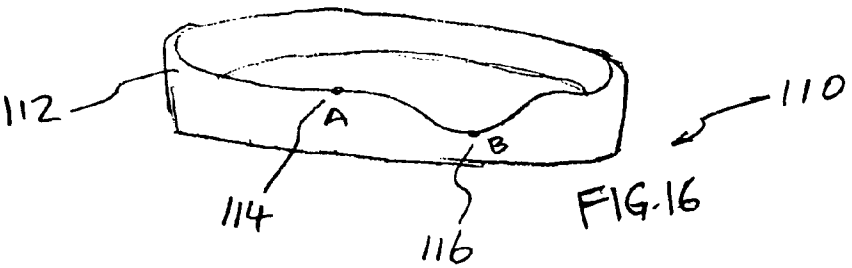
Figure 17:
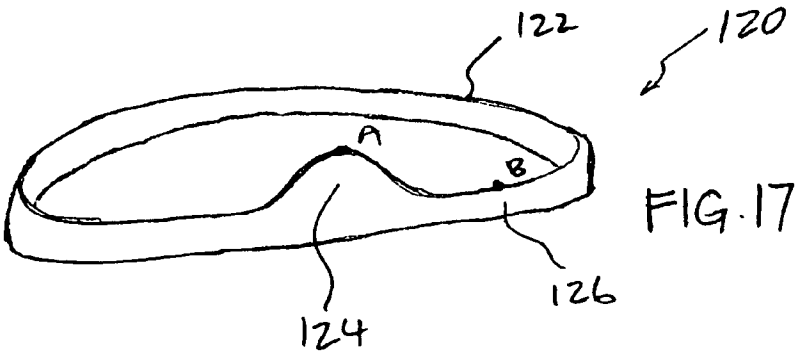

The retaining ring may be provided with annular lip profiles that are different from that shown in FIG. 8. For example, FIG. 15 illustrates another embodiment of the retaining ring 100, in which changes in the uneven annular lip 102 is more abrupt between point A and point. B. Instead of a symmetrical retaining ring 28 having an annular lip 91 with two taller sections 95 and two shorter sections 97, alternatively as shown in FIG. 16, the retaining ring 110 may comprise an annular lip 112 with a single continuous taller section 114 and a single shorter section 116. Further (not shown), more than two taller sections 95 and shorter sections 97 may be provided for the annular lip 91. In another embodiment shown in FIG. 17, the uneven retaining ring 120 may have a single continuous shorter section 126 with only a single taller section 124. Alternatively (not shown), two or more taller sections 124 may be provided.

Figure 18:
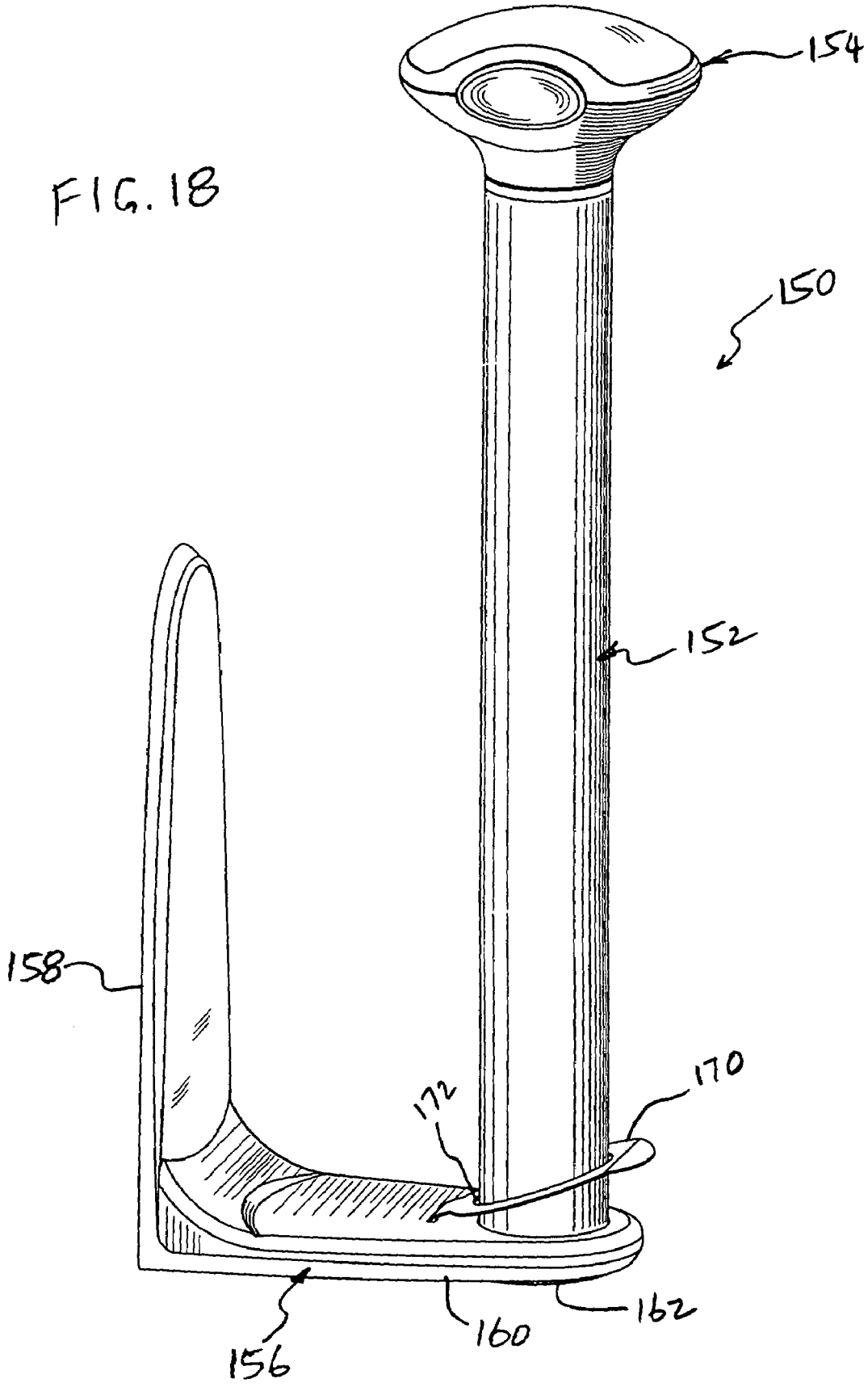
FIG. 18 is a perspective view of a paper towel holder in accordance with another embodiment of the present invention.
Figure 19:
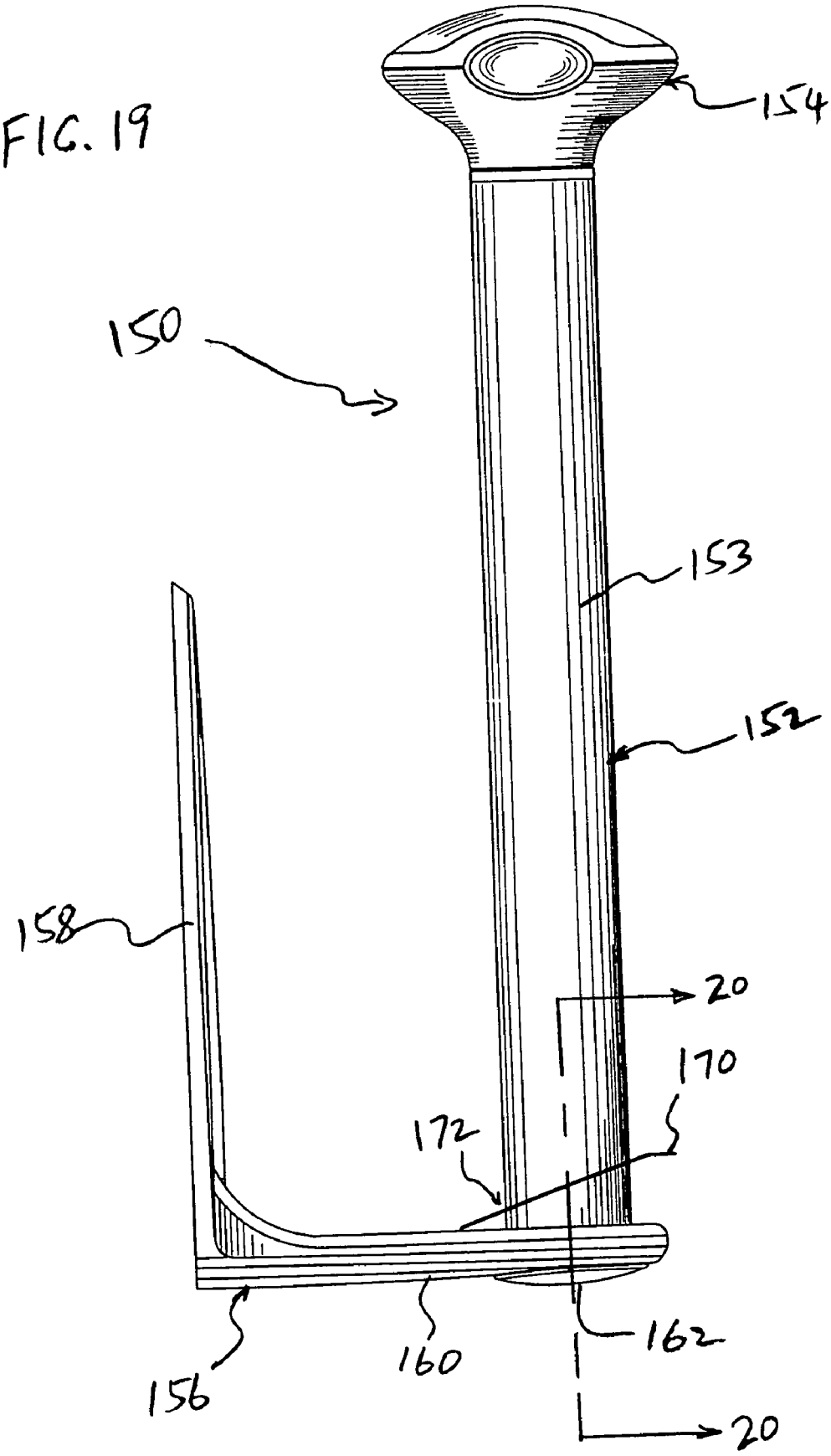
FIG. 19 is a side view of the paper towel holder of FIG. 18.
Figure 20:
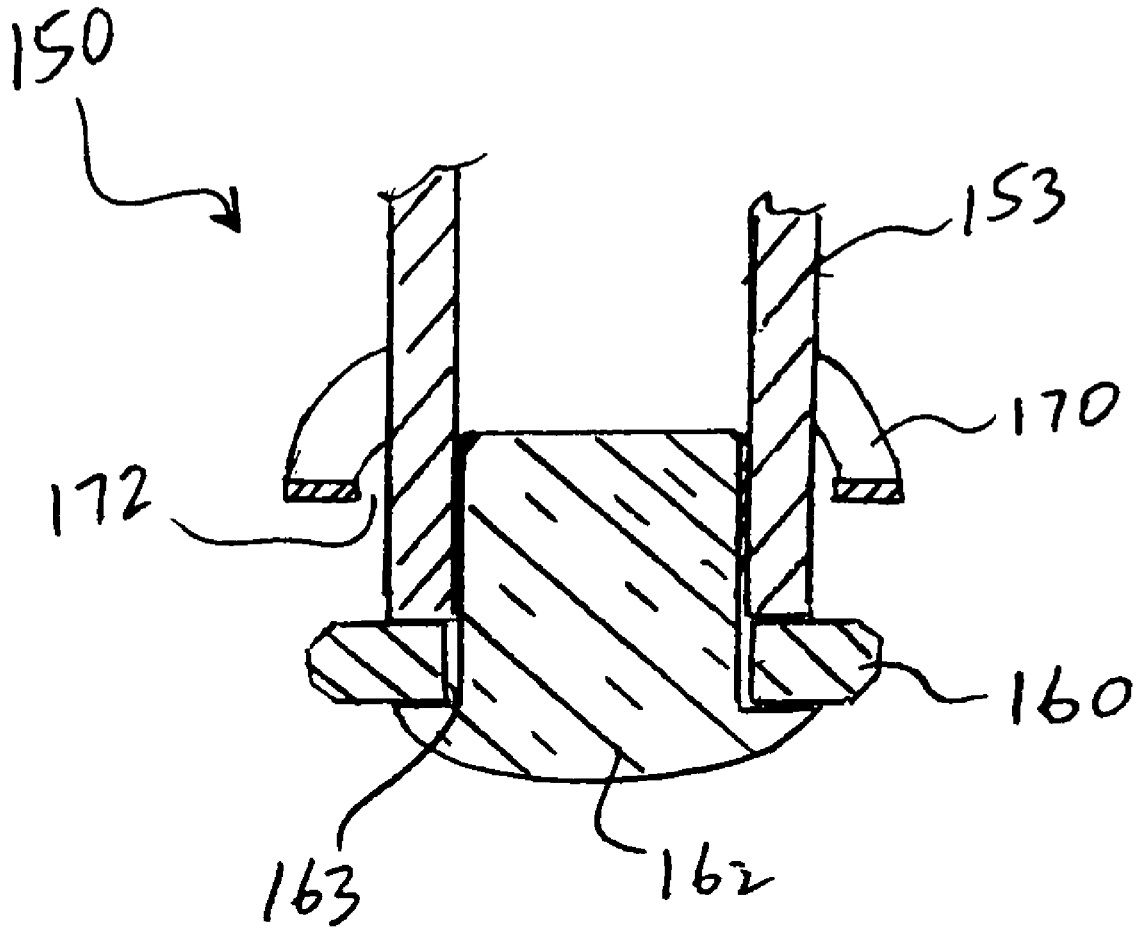
FIG. 20 is a sectional view taken along line 20-20 in FIG.18.
Figure 21:
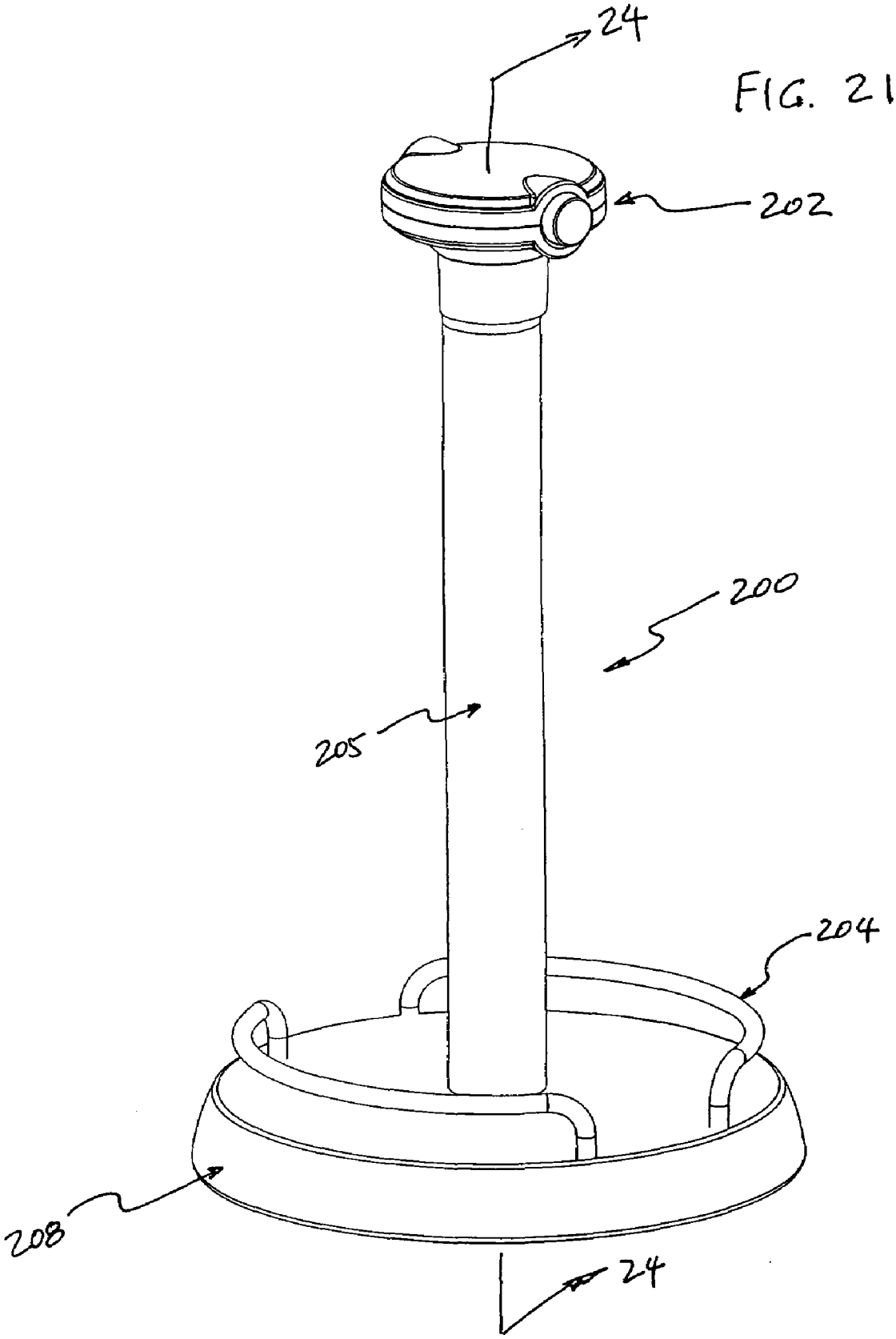
FIG. 21 is a perspective view of a paper towel holder in accordance with yet another embodiment of the present invention.

FIGS. 18 to 20 illustrate an embodiment of the paper towel holder in accordance with a further aspect of the present invention. In this aspect, the paper towel holder is structured for mounting to a vertical surface, such as a wall or the side of a cabinet.

FIG. 18 is a perspective view of a paper towel holder 150 in accordance with one embodiment of the present invention, for supporting a roll of paper towels (not shown, but similar to paper towel roll 60 in the previous embodiment). The holder 150 comprises primarily a pole 152, a handle 154 and a base 156. The handle 154 may be similar to the handle 40 in the earlier embodiment.

The base 156 is generally L-shaped, including a horizontal base section 160 and a vertical mounting section 158. The mounting section 158 may be provided with screw holes (not shown) for mounting screws, or mounting tracks (not shown) at the back of the mounting section for concealed mounting to a mounting bracket on a vertical surface. This sort of conceal mounting is well know in the mounting art. The base section 160 is provided with a clearance hole 163 for receiving a mounting plug 162, as further discussed below.

The pole 152 may comprise a tube 153 similar to the tube 30 in the earlier embodiment. The top end of the tube 153 is similarly structured to work with the handle 154. The mounting of the tube 153 on the base 156 is different from the earlier embodiment. Instead of a plug for anchoring mounting screws as in the earlier embodiment, a plug 162 is provided to interference fit into the open bottom end of the tube 153, through the clearance hole 163 provided in the base section 160. The plug 162 may include barbed surface features (not shown) around its cylindrical body to provide better friction fit. The tube 153 is thus cantilevered and extends from the base section 160.

A spring 170 is provided, cantilevered and extending from the base section 160 (e.g., in the form of a metal leaf-spring). The spring 170 is has a generally ring-shaped section, having an aperture 172 that fits coaxially around the tube 153, with sufficient clearance with respect to the tube 153 over the designed range of travel of the spring 170. When a paper towel roll is loaded on the holder, the hub of the paper towel roll would be supported by the tube 153, with the bottom end of the hub resting on the spring 170. The weight of the roll would depress the spring 170, creating an upward reaction bias force. During the process or dispensing an end piece of paper towel from the roll, the end piece is gently tugged to unroll the end piece. The reaction bias of the spring 170 creates sufficient resistance to the hub of the paper towel roll to tend to hold the roll in place from unrolling too much. The user can tear off the end piece using a slight upward or downward motion to initiate a tear at the perforation, and completing the tearing of the end piece from the roll.

The vertical mounting section 158 of the holder 150 provides a barrier to excessive unraveling of the paper towel roll. The end piece of the paper towel roll would unravel until it touches the mounting section 158.

The base 156 may be made of molded plastic, or metal, such as stainless steel. The handle 154 and tube 152 may be made of plastic or metal, as in the earlier embodiment.

Variations of the vertical mounted paper towel holder 150 may be implemented without departing from the scope and spirit of the present invention. For example, the holder 150 may be provided with a circular base including a similar retaining ring as in the earlier embodiment. Such circular base may be coupled to a vertical mounting section for attachment to a vertical surface.

FIGS. 21 to 25 illustrate another embodiment of the paper towel holder in accordance with a further aspect of the present invention. In this embodiment, the present invention provides a quick-release, spring-biased retractable handle in the paper towel holder, which can be used to apply a braking force to restrain rotation of the paper towel roll. The handle is structured for quick release without requiring disassembly of any components, other than detaching the handle from the vertical pole to which it is attached. There would be no lose component parts that require re-assembling when the handle is installed back onto the pole. This aspect is similar to the prior embodiments described above. In the present embodiment, the handle is retractable with respect to the towel roll, when the handle is installed onto the pole. The handle is moveable, against a spring bias, axially with respect to the towel roll, thus allowing the bottom surface of the handle to frictionally engage the core of the towel roll. This feature is more clearly illustrated by reference to the drawings.

Referring to FIGS. 21 to 25, the paper towel holder 200 is similar to the paper towel holder 10 in connection with the embodiment illustrated in FIG. 1, with the exception of the handle 202 and the retaining ring 204 in this embodiment. Otherwise, the paper towel holder 200 has a pole 205 (which may be in the form of a tube 206, see FIG. 24), and a base 208, which may be similar in structure to the pole or tube 30 and base 20 in the embodiment of FIG. 1. The base 208 includes a new embodiment of an annular rim of uneven height at the periphery of the base 208. The annular rim is discontinuous, in the form of a two-section retaining ring 204. Each section spans less than half the perimeter of the base 208. A space is provided between adjacent ends of the sections. The two ends of each section of the retaining ring 204 are anchored to the base 208, with the rest of the section raised above the top surface of the base 208, as more clearly shown in FIG. 23. The section may comprise a plastic or metal wire or tubular structure, forming the rail like structure as shown. The retaining ring 204 retains the lose end of the roll 60 to within the perimeter of the base 208, and facilitates tearing of a piece of towel from the roll. Specifically, when a paper towel roll 60 is rest on the base 208, the two sections of the retaining ring 208 prevent undesired unraveling of the roll 60. The end piece of the roll may be tugged through the opening between the two sections and anchored against the end of a section, so that it may be torn off the roll in a "tug and peel" action much like that disclosed in the earlier embodiments. Such "tug and peel" action may be achieved by using one hand, without the assistance of another hand to hold the roll from further unrolling. This facilitates dispensing of paper towels, especially in a work environment such as a kitchen, in which one hand of the user may be occupied or unclean, while the other hand is the only hand available to tear off a piece of paper towel.

While the illustrated embodiment shows the retaining ring 204 in two symmetrical sections, the sections may be non-symmetrical or there may be more than two sections, without departing from the scope and spirit of the present invention.

Figure 22:
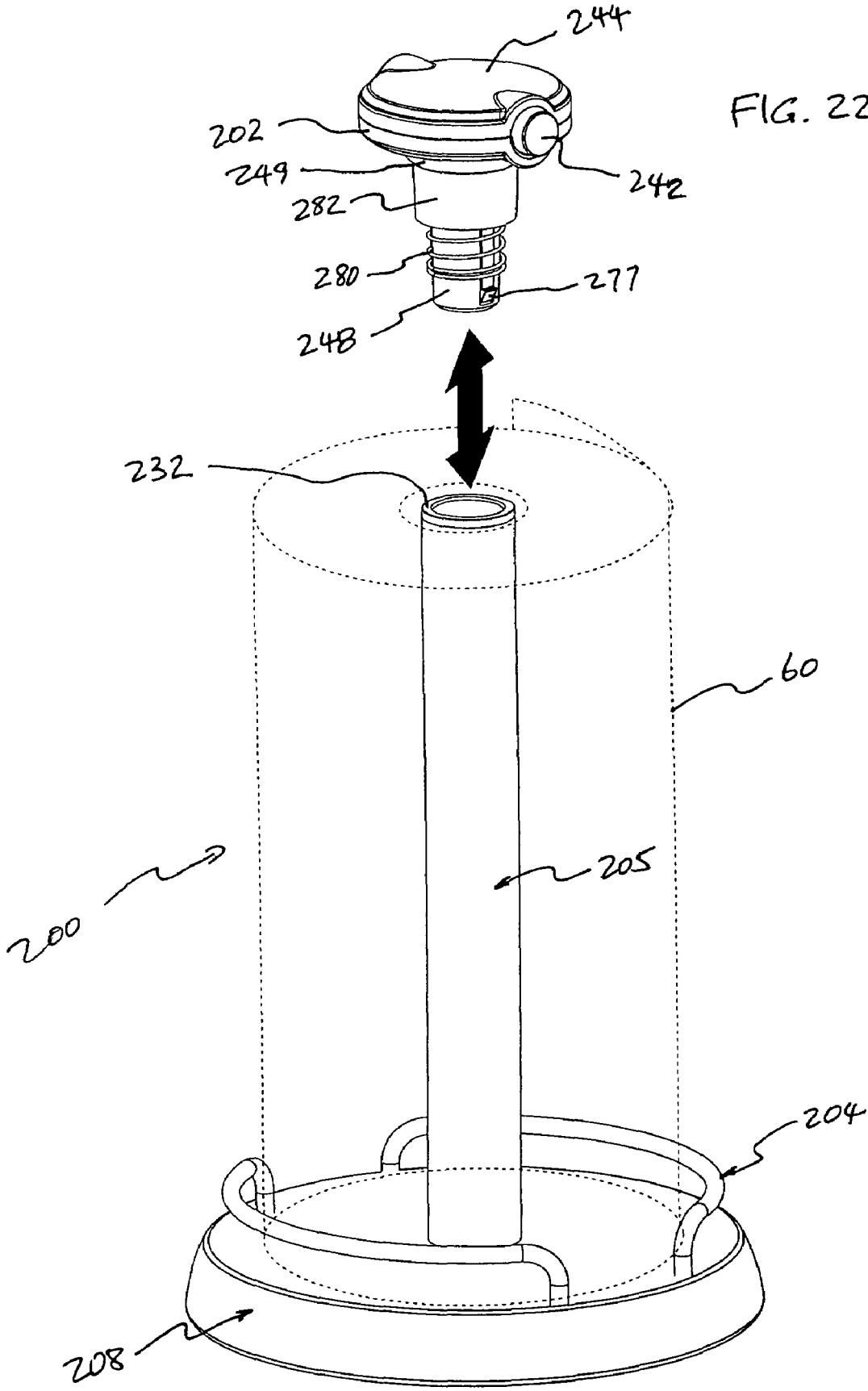
FIG. 22 is a perspective view of the paper towel holder of FIG. 21 with the handle detached from the pole.
Figure 23:
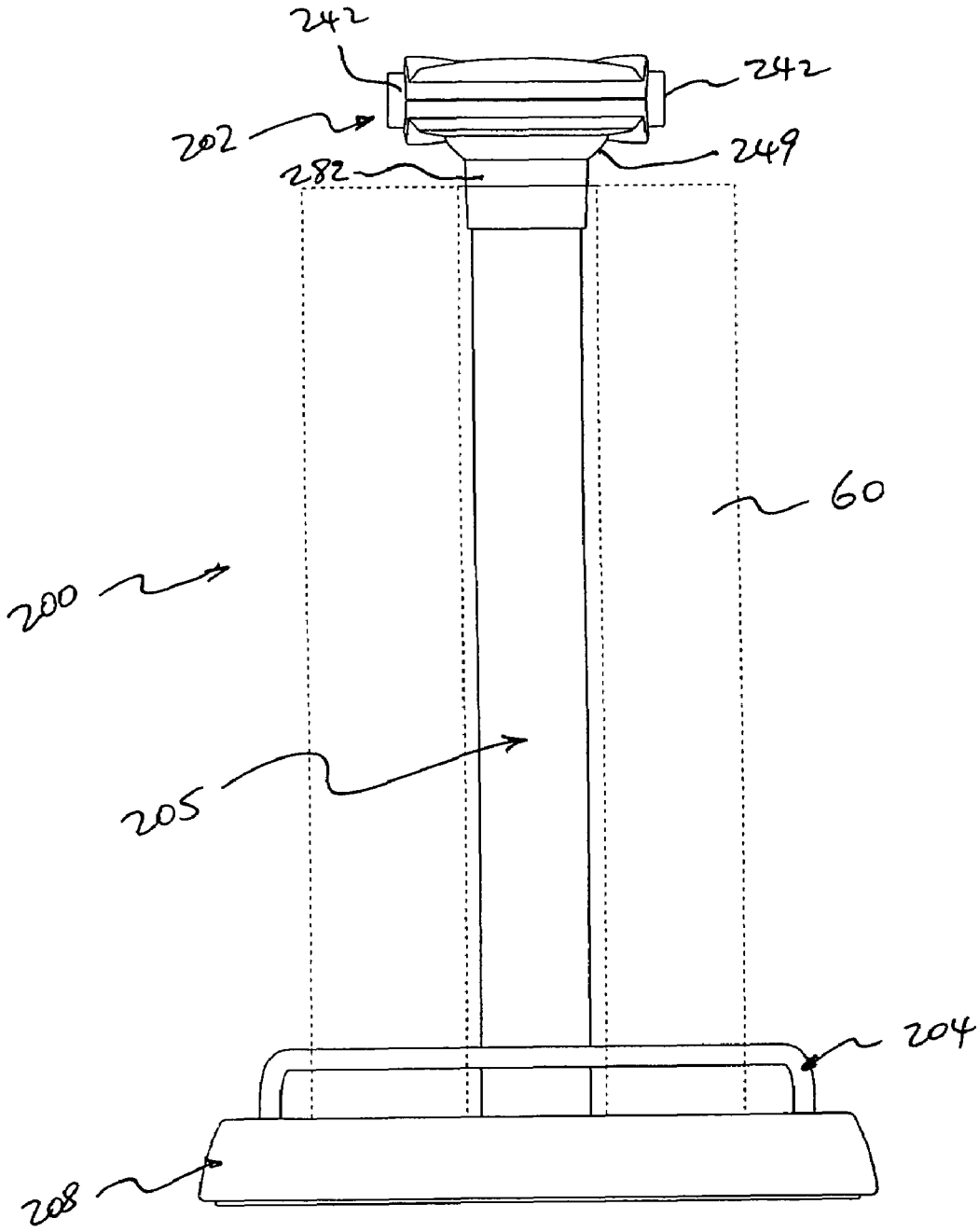
FIG. 23 is a side view of the paper towel holder of FIG. 21.
Figure 24:
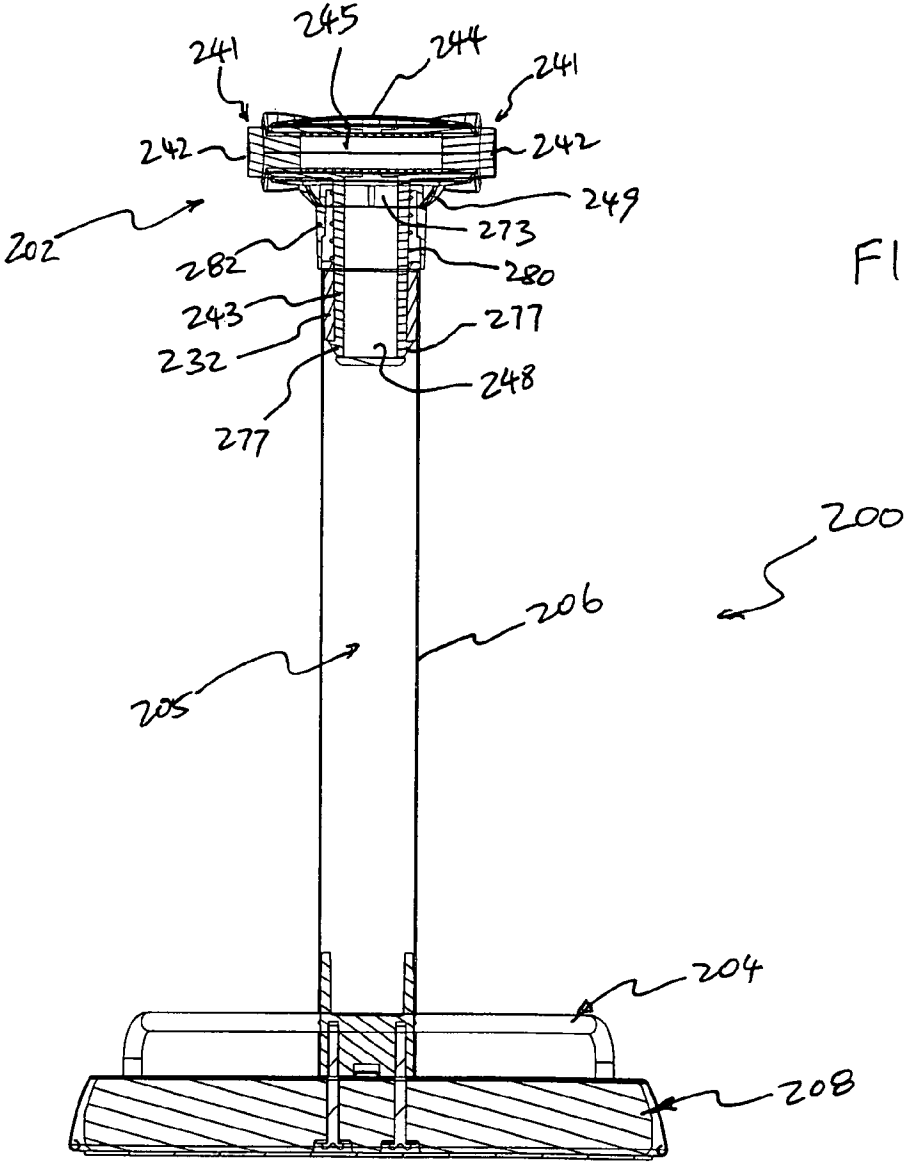
FIG. 24 is a sectional view taken alone line 24-24 in FIG. 21, illustrating details of the retractable handle.

According to the present embodiment, to further provide a mechanism to prevent undesired unrolling of the paper towel roll, the retractable handle 202 can be used to apply a braking force against the core of the paper towel roll 60. Referring to FIGS. 22 and 24, the structure of the handle 202 is in many respects similar to the knob shaped handle 40 of the earlier embodiment shown in FIGS. 3 and 4. The present embodiment improves on the earlier embodiment by providing axial retraction of the handle with respect to the tube 206.

The releasable handle 202 generally resembles a knob. The handle 202 comprises two release buttons 241, a lower body 273, and a cover 244. The structure of each release button 241 includes a button pad 242 attached to a latch 243. The latch 243 has a hook 277 at its end. The release button 241 could also include a slider (similar to the slider 71 shown in FIG. 3) to facilitate sliding motion of the release button structure in the handle 202. A hollow generally cylindrical or conical stem 248 extends from the bottom of the body 273. When assembled to the body 273, each latch 243 is inserted through the hollow stem 248, and has its hooks 277 extending through slots in the stem 248 (similar to the earlier embodiment shown in FIG. 3). A coil spring 245 is provided to bias the two latches 243 away from each other, thereby exposing the hooks of the latch 243 through the slots under bias of the spring 245. The cover 244 securely retains the spring within the handle 202. Screws (not shown) may be provided to secure the cover 244 in place on the lower body 273, or the cover may be coupled to the lower body 273 by a snap coupling (not shown). The cover 244 may be finished (e.g., provided with a thin stainless steel or aluminum face-plate, having a polished or textured surface) to render a desirable external finish to the handle 202. As in the earlier embodiment, the body 273, cover 244 and/or the release buttons 241 may be molded from plastic. The foregoing described structure is quite similar to the earlier embodiment.

At the top distal end of the tube 206, it has an inner diameter that is sized to receive a plastic cylindrical insert 232 with an interference fit. The inner diameter of the cylindrical insert 232 is sized to receive the stem 248 of the handle body 273. The length of the cylindrical insert 232 is such to allow the hooks 277 of the latch 243 to latch on to the bottom edge of the cylindrical insert 232, when the handle body 273 is fully inserted into the cylindrical insert 232. To detached the handle body 273 from the tube 206, the button pads 242 are depressed, such as by squeezing or pinching towards each other simultaneously against the spring bias, thereby retracting the hooks 277 to disengage from the bottom edge of the cylindrical insert 232. The foregoing described handle detachment is similar to the earlier embodiment.

Figure 25A:
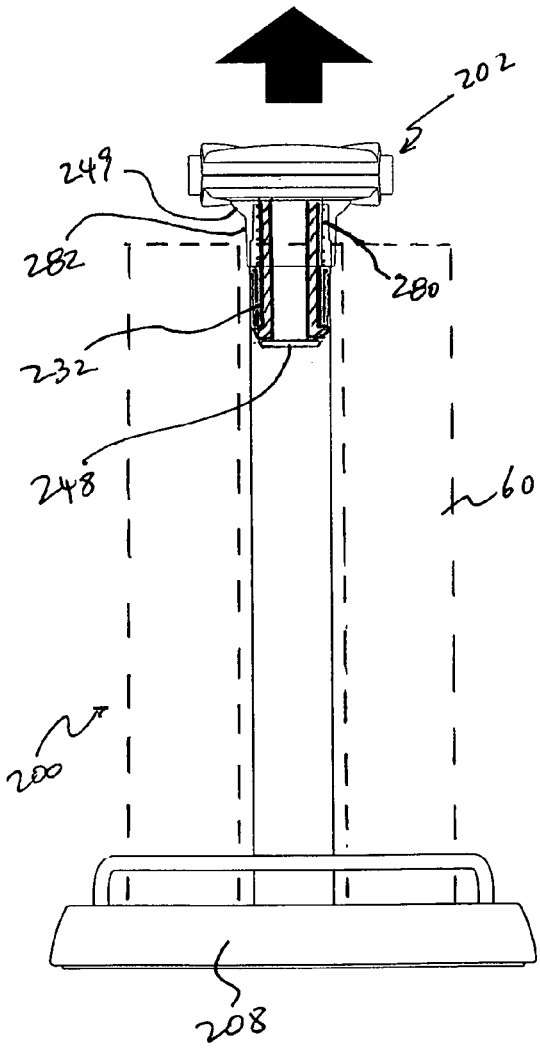
FIGS. 25(*a*) and 25(*b*) illustrate the positions of the handle relative to the towel roll.
Figure 25B:
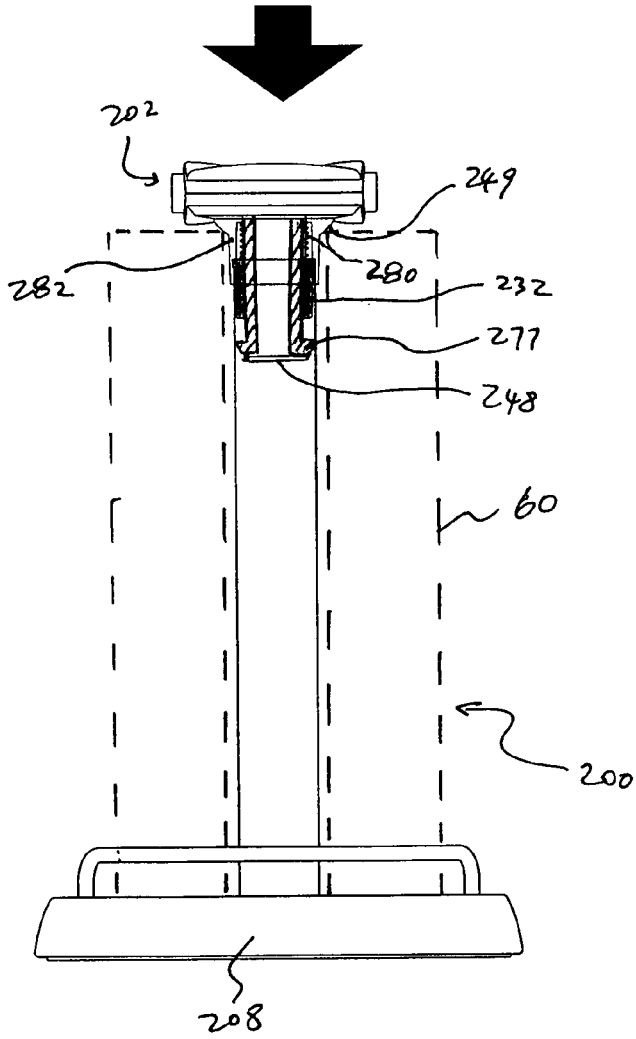

The present embodiment improves on the earlier embodiment by providing an axial spring bias to provide retractable axial motion of the handle 202. The spring bias may be implemented by a coil spring 280, which is provided axially around the cylindrical stem 248. The top end of the coil spring 280 rests against the root portion of the stem 248 at the lower body 273, and the lower end of the coil spring rests against the top of the insert 232 when the handle 202 is attached to the tube 206, as shown in FIG. 24. Unlike the earlier embodiment, the handle body 273 includes an annular collar 282 coaxial to the stem 248, and extending from the bottom surface of the handle. The inner diameter of the collar 282 is sized to freely slide along the outside of the tube 206. Referring also to FIGS. 25(*a*) and 25(*b*), when the handle 202 is pressed downwards by the user in the axial direction of the tube 206, the stem 248 slides downward further into the tube 206, compressing the coil spring 280, as shown in FIG. 25(*b*). At this state, the hooks 277 are no longer against the lower edge of the insert 232. The collar 282 slides on the outside of the tube 206. In FIG. 25(*a*), when the downward force is released, the coil spring 280 is relaxed, biasing the stem 248 to slide upwards, until the hooks 277 rest against the bottom edge of the insert 232. The collar 282 is sized with an axial length that covers the end of the tube 206 at this position, so as to conceal the coil spring 280.

The height of the tube 206, the bottom surface of the handle 202, and the range of axial motion of the handle 202 are chosen such that within the range of axial sliding motion permitted, the bottom surface of the handle 202 would engage and disengage the core of a standard size paper towel roll 60 that the holder 200 is designed to be used with. Specifically, upon downward motion of the handle 202 (sliding the stem 248 in the hollow end of the tube 206, the root portion at the bottom surface of the handle 202 would frictionally engage the core of the paper towel roll 60. Further, upon release of the handle 202 to retract the handle 202, the bottom surface of the handle 202 disengages from the core of the paper towel roll 60. Typically, the paper towel roll 60 includes a cardboard tube at its core, which is free to rotate about the tube 206. The end of this cardboard core provides a good, reliable frictional engagement with the bottom surface of the handle 202. Such frictional engagement provides a braking force to restrain further rotation of the roll 60. The bottom surface of the handle may include a transition 249 that is tapered, conical, or curved, transitioning from the bottom of the handle 202 to the collar 282 as illustrated. This transition 249 facilitates engagement against the core of the roll, by wedging against the core of the roll.

As can be appreciated, a user can use the palm of her hand, the back of her hand, her arm, her elbow, or any other part of her body to press the handle 202 downwards to stop the roll 60 from rotating, while she tears off a piece of paper towel from the roll 60. This embodiment present invention provides a convenient and effective structure to allow the user to tear paper towels, without having the need to use one of her hands to hold the towel roll. This is desirable, for example in a kitchen or workshop environment, the user's hand may be soiled, which could soil the roll if she handles the paper towel roll to stop it from rotating.

As in the earlier embodiment, the detachment of the handle from the tube 206 does not involve disassembling of individual parts or components. The entire handle 202, including all its parts, are intact within a unit. This makes it very convenient to re-attach the handle 202 to the tube 206. The coil spring 280 may be securely connected to the root of the stem 248, or it may be floating/slidable about the stem 248. The hooks 248 prevent the coil spring 280 from sliding off the stem 248. Instead of using a coil spring 280, the axial spring bias may be provided by other types of resilient means, such as a soft foam rubber cylinder that is compressible under an axial force.

It is noted that the handle 202 may be used, in place of the handle 40, with the tube 30 and base 20 shown in the embodiment of FIG. 1, and similarly in the embodiment shown in FIG. 18.

In the foregoing description of the various embodiments, the invention is described in reference to components that are shown to be separate discrete components. Some of these components may be integrated into a single unitary or monolithic structure, without departing from the scope and spirit of the present invention. For example, the retaining ring may be formed as an integral part of the cover. The vertical pole may be an integral part of the base. Similarly, some of the components may comprises two or more separate components coupled together. For example, for the vertical mount holder, the vertical mounting section may be coupled to a separate piece of base section by any attachment means.

While the invention has been particularly shown and described with reference to the preferred embodiments, it will be understood by those skilled in the art that various changes in form and detail may be made without departing from the spirit, scope, and teaching of the invention. A person skilled in the art will recognize that the holder incorporating the essence of this invention can also be used for holding a roll of thin ply sheets of other materials. Accordingly, the disclosed invention is to be considered merely as illustrative and limited in scope only as specified in the appended claims.

The invention claimed is:

1. A paper towel holder, comprising:

a base;

a pole having one end attached to the base, and a distal end extending upwardly from the base; and a quick-release detachable handle, removably and slidably coupled to the distal end, wherein the handle comprises a resilient member that biases against sliding motion of the handle with respect to the pole.

2. The paper towel holder as in claim 1, wherein the base comprises a base section to which the pole is attached, and an uneven retaining ring extending from the base section.

3. The paper towel holder as in claim 2, wherein the retaining ring comprises at least two sections, With adjacent ends of the sections separated by a space therebetween.

4. The paper towel holder as in claim 3, wherein the sections of retaining ring have a rail like structure extending from the base.

5. The paper towel holder as in claim 4, wherein the sections of the retaining ring are symmetrical arranged circumferentially on the base.

6. The paper towel holder as in claim 1, wherein the handle comprises a stem extending from bottom of the handle, and the distal end of the pole is hollow and sized to receive the stem for sliding motion.

7. The paper towel holder as in claim 6, wherein the resilient member comprises a coil spring disposed about the stem, between an edge at the distal end of the pole and a root portion of the stem, whereby the coil spring biases against sliding motion of the stem in a direction towards the base.

8. The paper towel holder as in claim 7, wherein the handle comprises a bottom surface, a collar extending from the bottom therefrom which slides outside the distal end of the pole, and a tapered, conical or curved transition from the bottom surface to the collar.

9. The paper towel holder as in claim 8, wherein the handle is structured to retain all its parts in a unit when it is detached from the pole.

10. The paper towel holder as in claim 8, wherein the pole comprises a collar inside the distal end of the pole, having a bottom edge towards the base; wherein the handle includes at least one spring loaded latch that extends from the stem and latches onto the bottom edge of the collar when the handle has been coupled to the distal end of the pole, and wherein the latch can be retracted into the stem to allow the handle to be detached from the pole.

11. The paper towel holder as in claim 10, wherein the stem is slidable inside the collar, from a position where the latch has a hook that is latched to the bottom edge of the collar, to a position where the hook is further away from the bottom edge of the collar.

12. The paper towel holder as in claim 1, wherein the handle comprises a stem extending from bottom of the handle, and the distal end of the pole is hollow and sized to receive the stem for sliding motion.

13. The paper towel holder as in claim 12, wherein the resilient member comprises a coil spring disposed about the stem, between an edge at the distal end of the pole and a root portion of the stem, whereby the coil spring biases against sliding motion of the stem in a direction towards the base.

14. The paper towel holder as in claim 13, wherein the handle comprises a bottom surface, a collar extending from the bottom therefrom which slides outside the distal end of the pole, and a tapered, conical or curved transition from the bottom surface to the collar.

15. The paper towel holder as in claim 14, wherein the handle is structured to retain all its parts in a unit when it is detached from the pole.

16. The paper towel holder as in claim 14, wherein the pole comprises a collar inside the distal end of the pole, having a bottom edge towards the base; wherein the handle includes at least one spring loaded latch that extends from the stem and latches onto the bottom edge of the collar when the handle has been coupled to the distal end of the pole, and wherein the latch can be retracted into the stem to allow the handle to be detached from the pole.

17. The paper towel holder as in claim 16, wherein the stem is slidable inside the collar, from a position where the latch has a hook that is latched to the bottom edge of the collar, to a position where the hook is further away from the bottom edge of the collar.

18. A paper towel holder, comprising:

a base;

a pole having one end attached to the base, and a distal end extending upwardly from the base, for supporting a roll of paper towel for rotation about the pole, wherein the roll has an end near the distal end of the pole;

a quick-release detachable handle, removably and slidably coupled to the distal end, wherein the handle comprises a resilient member that biases against sliding motion of the handle with respect to the pole, wherein when the roll is placed between the base and the handle, upon sliding motion of the handle in a direction towards the base, the handle engages the end of the roll to restrain rotational motion of the roll about the pole.

19. A paper towel holder, comprising:

a base;

a pole having one end attached to the base, and a distal end extending upwardly from the base;

a quick-release detachable handle, removably and slidably coupled to the distal end, wherein the handle comprises a resilient member that biases against sliding motion of the handle with respect to the pole, a roll of paper towel supported between the base and the handle, and rotatable about the pole, wherein the roll has an end near the distal end of the pole;

wherein upon sliding motion of the handle in a direction towards the base, the handle engages the end of the roll to restrain rotational motion of the roll about the pole.

20. The paper towel holder as in claim 19, wherein the resilient member comprises a coil spring disposed between an edge at the distal end of the pole and a root portion of the handle, whereby the coil spring biases against sliding motion of the handle in a direction towards the base.

* * * * *